US008376804B2

(12) United States Patent
Willett et al.

(10) Patent No.: US 8,376,804 B2
(45) Date of Patent: Feb. 19, 2013

(54) MOTORIZED TOY CREATURE

(75) Inventors: William Willett, Irvine, CA (US); Chung Ming (Bryan) Cheng, Kowloon (CN); Chun Wing (Edward) Wong, Kowloon (CN)

(73) Assignee: Mattel, Inc., El Segundo, CA (US)

( * ) Notice: Subject to any disclaimer, the term of this patent is extended or adjusted under 35 U.S.C. 154(b) by 1140 days.

(21) Appl. No.: 12/263,945

(22) Filed: Nov. 3, 2008

(65) Prior Publication Data

US 2009/0137186 A1 May 28, 2009

Related U.S. Application Data

(63) Continuation of application No. PCT/US2007/010979, filed on May 4, 2007.

(60) Provisional application No. 60/915,899, filed on May 3, 2007, provisional application No. 60/797,778, filed on May 4, 2006.

(51) Int. Cl.
*A63F 3/36* (2006.01)

(52) U.S. Cl. ..... 446/368; 446/330; 446/431; 446/434

(58) Field of Classification Search ..... 446/175
See application file for complete search history.

(56) References Cited

U.S. PATENT DOCUMENTS

| | | | | |
|---|---|---|---|---|
| 1,049,345 | A | | 1/1913 | Dolman |
| 1,429,571 | A | | 9/1922 | Davis |
| 1,486,101 | A | | 3/1924 | Megorden |
| 2,035,308 | A | | 3/1936 | Ferber |
| 2,194,537 | A | | 3/1940 | Adams |
| 2,232,615 | A | | 2/1941 | Frank |
| 2,596,216 | A | | 5/1952 | Dawson |
| 2,728,168 | A | | 12/1955 | Gier |
| 2,853,831 | A | | 9/1958 | Bischoff |
| 3,119,201 | A | | 1/1964 | Brown et al. |
| 3,132,864 | A | * | 5/1964 | Glass et al. ..... 273/127 R |
| 3,151,866 | A | * | 10/1964 | Glass et al. ..... 273/359 |
| 3,181,270 | A | | 5/1965 | Dale |
| 3,395,483 | A | | 8/1968 | Mullins |
| 3,456,381 | A | | 7/1969 | Kinberg |
| 3,490,172 | A | | 1/1970 | Schwartz |
| 3,538,639 | A | | 11/1970 | Tomaro |
| 3,540,151 | A | | 11/1970 | Ishida |
| 3,765,693 | A | | 10/1973 | Morrison et al. |
| 4,143,484 | A | | 3/1979 | Yonezawa |
| 4,402,158 | A | * | 9/1983 | Seki et al. ..... 446/198 |

(Continued)

FOREIGN PATENT DOCUMENTS

| | | | |
|---|---|---|---|
| DE | 650876 | C | 10/1937 |
| FR | 2597002 | A1 | 10/1987 |

OTHER PUBLICATIONS

Supplemental European Search Report dated May 7, 2010; (8 pages) for corresponding EPO 07776819.0-2318.

(Continued)

*Primary Examiner* — Tramar Harper
(74) *Attorney, Agent, or Firm* — Panitch Schwarze Belisario & Nadel LLP

(57) ABSTRACT

A multi-directional radio controlled toy, having a main vehicle with housing configured as a creature-like head containing propulsion and control components including two drive motors with controller, drive wheels coupled with the motors, power supply and wireless signal receiver coupled with the controller. An unpowered body portion trails the main vehicle and body members movably connected together by articulated couplings to permit body articulation throughout substantially the entire body portion of the creature-like device. A jaw moving mechanism in the main vehicle is powered by the motors to raise an upper jaw portion of the head until tripped by contact of a trigger at the front end of the main vehicle.

17 Claims, 3 Drawing Sheets

U.S. PATENT DOCUMENTS

| | | | | |
|---|---|---|---|---|
| 4,417,523 | A | 11/1983 | Mariol | |
| 4,419,841 | A | 12/1983 | Huang | |
| 4,459,776 | A | 7/1984 | Jaworski et al. | |
| 4,575,350 | A | 3/1986 | Hippely et al. | |
| 4,595,378 | A | 6/1986 | Sweet et al. | |
| 4,674,585 | A | 6/1987 | Barlow et al. | |
| 4,680,022 | A | 7/1987 | Hoshino et al. | |
| 4,698,044 | A | 10/1987 | Kennedy et al. | |
| 5,474,486 | A | 12/1995 | Chilton et al. | |
| 5,628,667 | A * | 5/1997 | Levi | 446/278 |
| 5,752,871 | A | 5/1998 | Tsuzuki | |
| 5,964,640 | A * | 10/1999 | Barton et al. | 446/454 |
| 6,409,511 | B2 | 6/2002 | Cogliano | |
| 6,435,931 | B1 | 8/2002 | Yaeger et al. | |
| 6,454,624 | B1 | 9/2002 | Duff et al. | |
| 6,461,218 | B1 | 10/2002 | Mullaney et al. | |
| 6,662,889 | B2 | 12/2003 | De Fazio et al. | |
| 6,679,750 | B1 | 1/2004 | Nielsen | |
| 6,786,795 | B1 * | 9/2004 | Mullaney et al. | 446/431 |
| D569,923 | S | 5/2008 | Pasko | |
| 7,387,179 | B2 * | 6/2008 | Anhalt et al. | 180/9.1 |
| 7,387,558 | B2 | 6/2008 | Swisher et al. | |
| 2002/0111111 | A1 | 8/2002 | Mullaney et al. | |
| 2003/0017762 | A1 | 1/2003 | Bernier et al. | |
| 2003/0017782 | A1 | 1/2003 | Man | |
| 2003/0040250 | A1 | 2/2003 | Yim et al. | |
| 2004/0198156 | A1 | 10/2004 | Theel | |

OTHER PUBLICATIONS

Catalogue entitled: Tyco Toys 1995, (cover page and p. 7).
2 pages with images of 3 segmented snake embodiments.

* cited by examiner

MOTORIZED TOY CREATURE

CROSS-REFERENCE TO RELATED APPLICATIONS

This patent application claims priority to U.S. Provisional Patent Application No. 60/797,778, filed May 4, 2006, entitled "Remote Controlled Toy Creature", and to U.S. Provisional Patent Application No. 60/915,899, filed May 3, 2007, entitled "Motorized Toy Snake", and is a continuation of to International Application No. PCT/US07/10979 filed May 4, 2007 entitled "Motorized Toy Creature", the disclosures of which are incorporated by reference herein in their entireties.

BACKGROUND OF THE INVENTION

The present invention relates generally to toy vehicles and, more specifically, to a motorized toy vehicle having the appearance of a stylized, multi-sectioned snake. It further relates to toy vehicles that have an additional action component beyond movement.

BRIEF SUMMARY OF THE INVENTION

Briefly stated, the present invention is directed to a motorized, multi-segmented, articulated toy snake comprising: a chassis segment having a front end and a rear end, a top side and an opposing bottom side, at least first and second ground contacting drive wheels mounted side-by-side on the bottom side between the front end and the rear end, the chassis segment including an outer housing with a snake-head-like appearance, at least a first electric motor operably connected to at least the first drive wheel, a second electric motor operably connected to at least the second drive wheel, an electric power supply and an electric controller selectively operably connecting at least the first electric motor and the second motor with the electric power supply, an upper jaw member or portion of the outer housing being hinged to the chassis or a remainder of the outer housing; and a multi-segmented body pivotally coupled to the rear end of the chassis, the body including at least a plurality of individual body segments connected end to end, a first body segment being articulated to the rear end of the chassis and a front end of each other body segment of the plurality being articulated to a rear end of a proceeding body segment of the plurality, each body segment including a carriage, each carriage a top side, a bottom side and first and second opposing lateral sides extending between the front and rear ends.

In another aspect, the invention is directed to a motorized biting toy comprising: a chassis with an outer housing and a movable jaw member pivotally coupled with one of the chassis and outer housing; at least first and second ground contacting wheels rotatably supported from the chassis; motor means operably coupled with at least the first and second least first and second ground contacting wheels to drive the wheels and thereby maneuver the toy vehicle; a jaw moving mechanism powered by the motor means to raise the movable jaw member; and a trigger extending from the chassis and outer housing and operably coupled with the jaw moving mechanism to release the movable jaw member from a raised position.

In another aspect, the invention is a motorized toy comprising: a chassis with an outer housing; at least first and second ground contacting wheels rotatably supported from the chassis; a first reversible motor operably connected with at least the first of the first and second ground contacting wheels to drive the first wheel; a second reversible motor operably connected with at least the second of the first and second ground contacting wheels to drive the second wheel, the second motor being separately operable from the first motor to maneuver the toy vehicle; a movable member movably coupled with one of the chassis and outer housing; and a moving mechanism operably connected with the movable member sufficiently to move the movable member from a first position to a second position, the moving mechanism being powered only by simultaneous operation of the first and second motors

BRIEF DESCRIPTION OF THE SEVERAL VIEWS OF THE DRAWINGS

The foregoing summary as well as the following detailed description of the preferred embodiment of the invention will be better understood when read in conjunction with the appended drawings. It should be understood, however, that the invention is not limited to the precise arrangements and instrumentalities shown herein. The components in the drawings are not necessarily to scale, emphasis instead being placed upon clearly illustrating the principles of the present invention. Moreover, in the drawings, like reference numerals designate corresponding parts throughout the several views.

The invention may take physical form in certain parts and arrangement of parts. For a more complete understanding of the present invention, and the advantages thereof, reference is now made to the following description taken in conjunction with the accompanying photographs/drawings, in which.

DETAILED DESCRIPTION OF THE INVENTION

Figure 1:
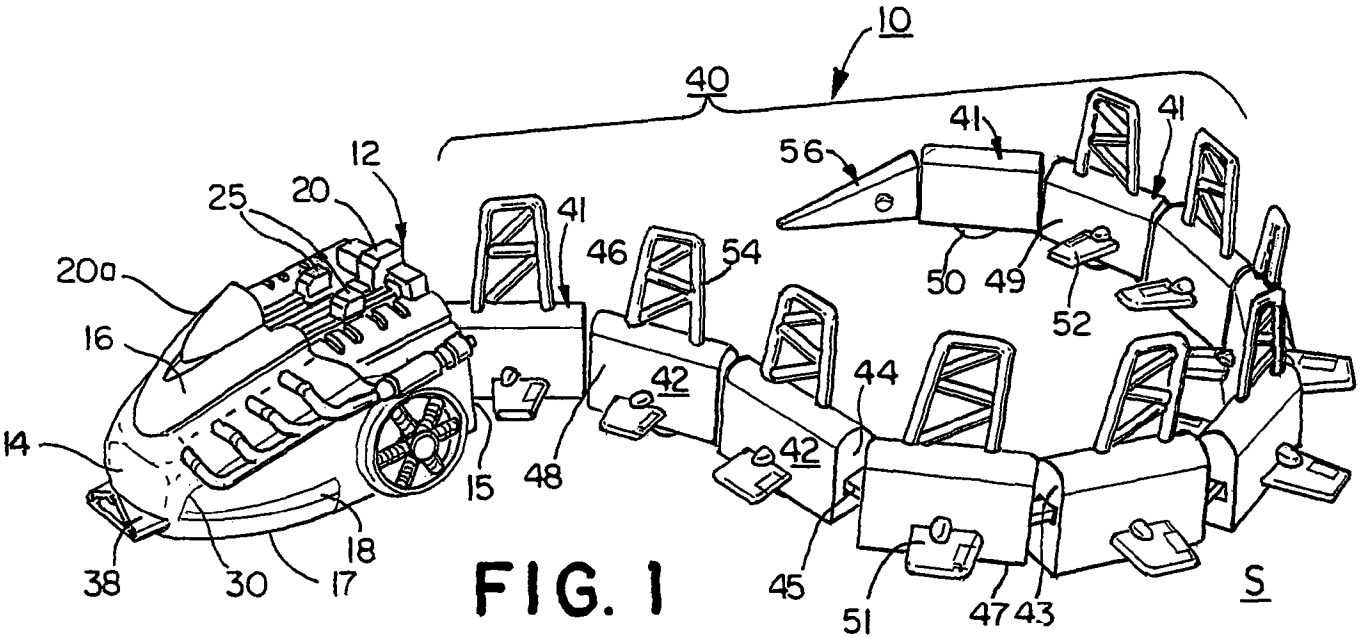
FIG. 1 is a perspective view of the upper and left side of a motorized, articulated, segmented toy snake in accordance with one embodiment of the present invention.
Figure 2:
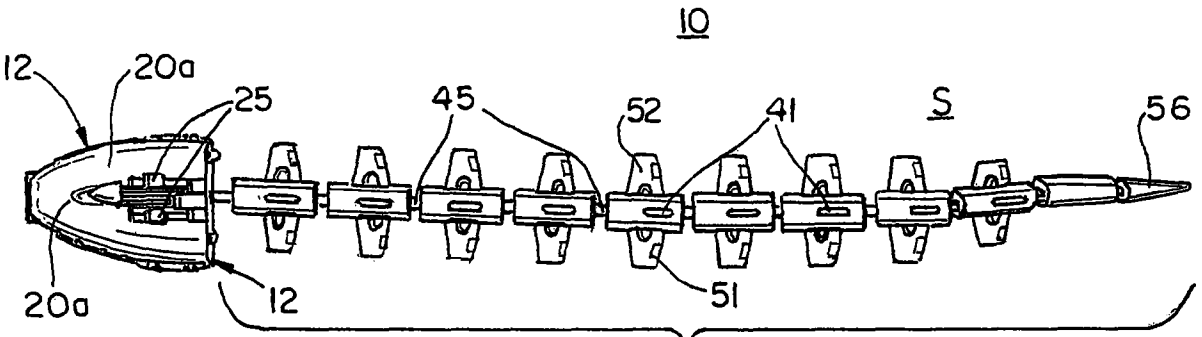
FIG. 2 is a top view of the toy snake of FIG. 1 extended out straight.
Figure 3:
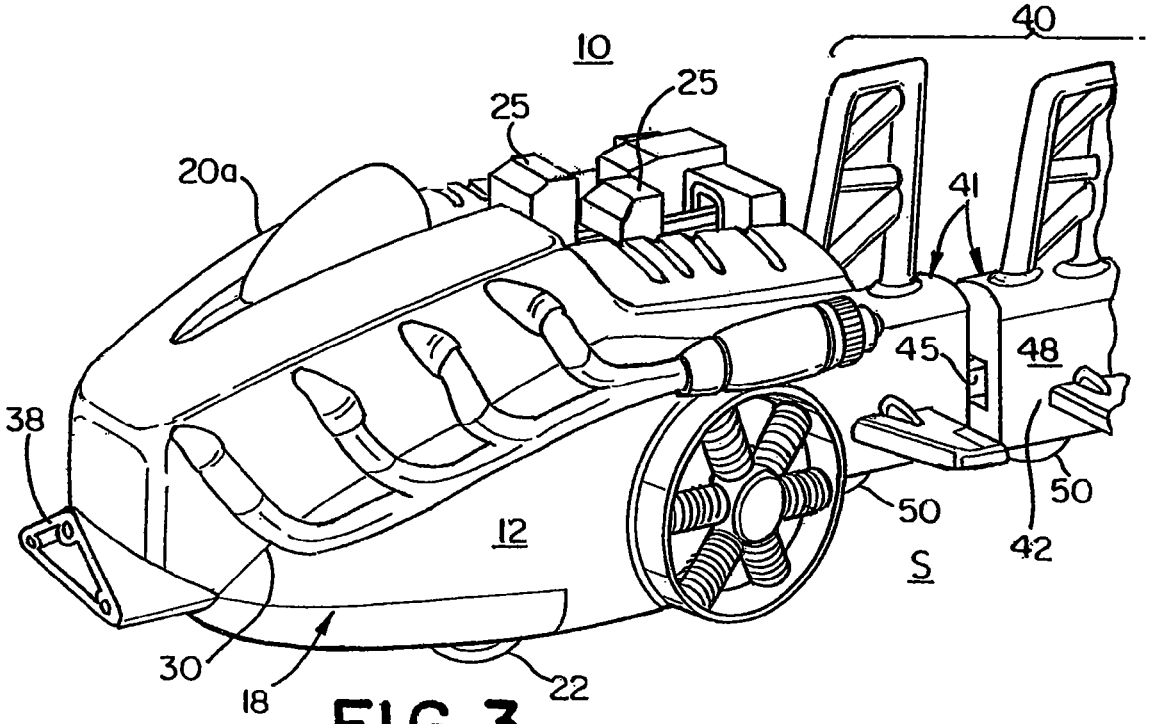
FIG. 3 depicts a perspective view of the front, top and left side of a snake-head-like outer housing covering a chassis of the toy snake.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions.

Briefly, the present invention provides a motorized toy, in particular, a creature-like vehicle device (e.g., an articulable segmented snake) comprising a creature-head-like housing portion for containing the drive and control components preferably including at least a motor controller, a plurality of drive/support wheels, a power supply, a radio signal receiver and at least two drive motors and accompanying gear mechanisms for providing differential drive control capability. The body portion of the creature-like device comprises a plurality of body members connected together end to end in such a fashion as to permit articulation between the head and the body and between each of the body members throughout substantially the entire body portion of the creature-like device. Each body member comprises at least one rotatable wheel for permitting mobility across a surface. A hand held radio signal transmitter is also provided for remote control capability, thereby enabling the toy to become dynamic.

The following discussion is presented to enable a person skilled in the art to make and use the invention. The general principles described herein may be applied to embodiments and applications other than those detailed below without departing from the spirit and scope of the present invention as defined by the appended claims. The present invention is not intended to be limited to the embodiments shown, but is to be accorded the widest scope consistent with the principles and features disclosed herein.

Certain terminology is used in the following description for convenience only and is not limiting. The words "right," "left," "lower" and "upper" designate directions in the photographs to which reference is made. The words "inwardly" and "outwardly" refer to directions toward and away from, respectively, the geometric center of the toy vehicle and designated parts thereof. The terminology includes the words specifically mentioned, derivatives thereof and words of similar import. The terms "horizontal" and "vertical" relate to the toy vehicle oriented with all of its wheels in contact with the ground. Additionally, the word "a" as used in the specification means "at least one."

Referring now to the photographs/drawings in detail, wherein like numerals indicate like elements throughout, there is shown in FIGS. 1-5 a first embodiment of a motorized, multi-segmented, articulated toy creature vehicle, in this case configured as a snake vehicle (or simply "toy snake") indicated generally at 10. Toy snake 10 includes a head segment (or simply "head") indicated generally at 12 and a multi-segmented body indicated generally at 40 that is pivotally coupled to one end, a rear end 15, of the head 12. Head 12 also has a front end 14, a top side 16 and an opposing bottom side 17. The head 12 includes a chassis 18 supporting an outer housing indicated generally at 20 with a snake-head-like appearance. The outer housing includes a movable upper jaw member or portion indicated generally at 20*a* pivotally coupled with the chassis 18 (or remainder of the outer housing) so as to define a mouth indicated generally at 30 with the remainder of the outer housing 20. The mouth 30 is capable of imitating a "striking" open position (not shown in the figures) by means of the upward pivot of the upper jaw portion 20*a* on the remainder of the outer housing 20 and chassis 18 and is triggered to a closed position by way a mechanical switch as will be described with respect to FIGS. 4-5 but including a movable actuator or trigger 38 seen at the lower front end of the head 12. Optionally, light elements such as LED's 25, can be provided on the top of the outer housing 20 in position to mimic the appearance of glowing eyes.

Figure 6:
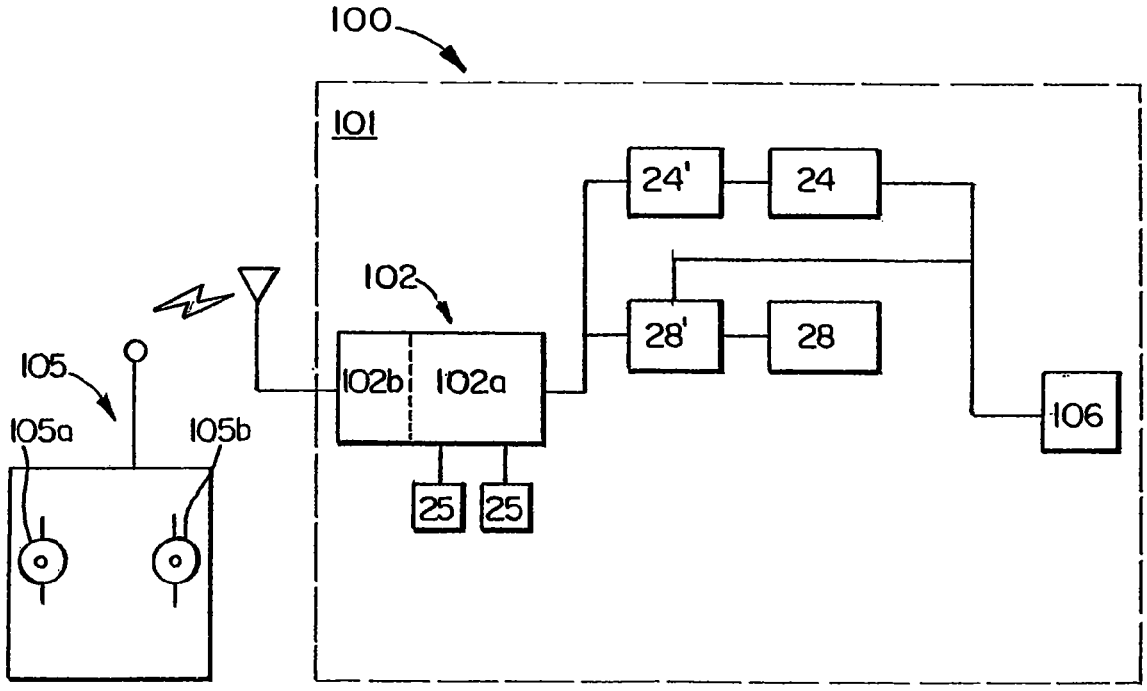
FIG. 6 is a diagrammatic schematic of the primary electrical components of the toy snake of the previous figures.

The power, propulsion and control elements of the toy snake, are all housed in the head section 12 and are shown schematically in FIG. 6. The toy snake 10 is preferably configured for wireless remote control using a wireless remote control transmitter indicated generally at 105. Preferably movement of the toy snake 10 is initiated and controlled via wireless, preferably radio signals from the wireless remote control transmitter 105. However, other types of controllers may be used including other types of wireless controllers (e.g., infrared, ultrasonic and/or voice-activated controllers) and even wired controllers and the like. The toy snake 10 is provided with a conventional circuit board 101 mounted control circuitry 100. The control circuitry 100 includes a controller 102 having a wireless signal receiver 102*b* and a microprocessor 102*a* plus any necessary related elements such as memory. The control circuitry 100 further preferably includes a first motor control circuit 24*a* and a second motor control circuit 28*a* for independently reversibly controlling a left side reversible electric motor 24 and a right side reversible electric motor 28. The motors 24, 28 are controlled by the microprocessor 102*a* through motor control subcircuits 24*a*, 28*a* which, under control of microprocessor 102*a*, selectively operably connects each motor 24, 28 with an electric power supply 62 (such as one or more disposable or rechargeable batteries 64). The microprocessor 102*a* can also selectively supply power to the light elements 25 and to any other electrical accessory items (such as other lights or a sound speaker).

Figure 5:
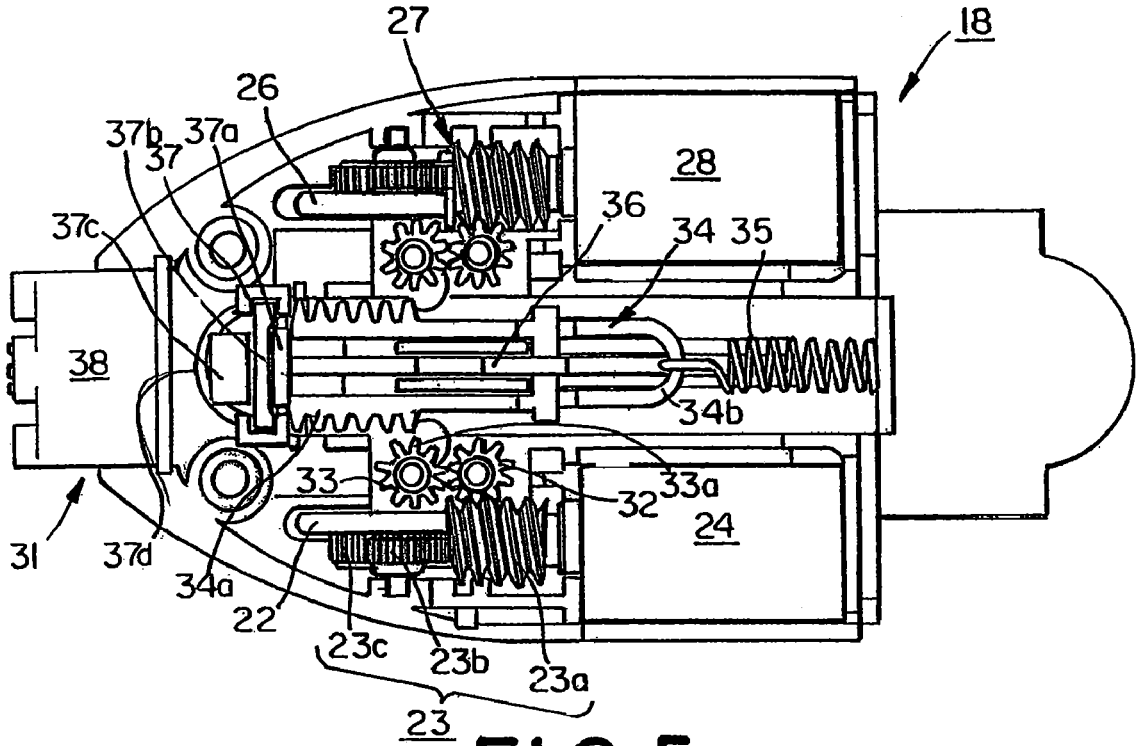
FIG. 5 is a top plan view of the chassis of FIG. 4.
Figure 4:
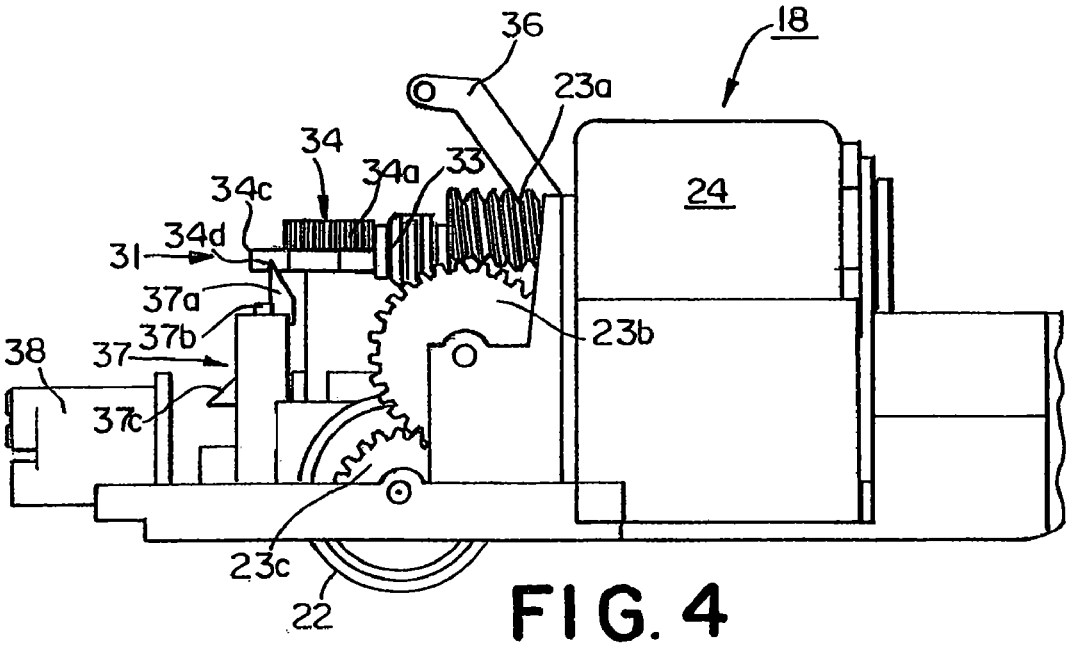
FIG. 4 is a left side elevation of the chassis of the toy snake of the previous figures with the snake-head-like outer housing removed.

Referring to FIGS. 4 and 5, there are shown in these figures the motive components of the toy snake 10. The first electric motor 24 is operably connected to at least the first (left side) ground contacting drive wheel 22 through a first drive train indicated generally at 23 while the second electric motor 28 is operably connected to at least the second (right side) ground contacting drive wheel 26 through a second, preferably mirror image drive train indicated generally at 27. Since the depicted drive trains 23, 27 are mirror images, only 23 is addressed. Train 23 is a gear train that includes a worm 23*a* driven by the motor 24 and driving a worm gear 23*b* which drives a wheel gear 23*c* fixed with wheel 22 to rotate the wheel with rotation of the gear 23*c*. The remaining mechanical components in FIGS. 6 and 7 are part of a jaw moving mechanism indicated generally at 31, which is devoted to raising and then abruptly releasing and dropping the upper jaw portion 20*a*.

The jaw moving mechanism 31 includes an idler gear 32 and a swing gear 33 on either side of a rack member 34. Each idler gear 32 is driven by a separate one of the motors 24, 28 through its worm 23*a*. Each idler gear 32 is meshed with swing gear 33, which is free to swing back and forth in a slot 33*a* when rotated by gear 32. The other elements of the jaw moving mechanism 31 include a rack member 34 mounted for linear movement in forward and reverse directions between the swing gears 33, a return spring 35, a cam arm 36, a latch 37 and the actuator/trigger 38. The rack member 34 includes a forward end with opposing racks 34*a* facing swing gears 33. When both motors 24, 28 are driven in reverse, each swing gear 33 is moved in its slot 33*a* towards the rack member 34 and into driving engagement with the adjoining rack 34*a*. Both motors must be driven in reverse at the same time to trap the rack member 34 between both swing gears in order to provide driving engagement between the swing gear 33 and the rack 34*a*. If only one motor is driven in reverse, the rack member will displace away from the driving swing gear and will not be advanced. When both motors are driven in reverse, the swing gears 33 engaging the racks 34*a* on either side of the member 34 drive the member 34 in a forward direction against the bias of spring 35 which secures an innermost end 34*b* of the member 34 most proximal to the spring 35 with the chassis 18. The rack member 34 has a forward extending arm 34*c* which has been cut away in FIG. 5 to reveal the underlying latch 37. The bottom side of the arm 34*c* has a cut-out forming a catch 34*d* which will be engaged by the latch portion 37*a* of latch member 37. Latch portion 37*a* is located at the top of a slide frame 37*b* which connects the latch portion 37*a* with a trip member portion 37*c* at the bottom of the frame 37*b*. Latch member 37 is biased into the raised position shown in FIG. 6 by an underlying bias member such as a spring 37*d* (mostly hidden in FIG. 5) beneath the slide frame 37*b*. When the rack member 34 is driven forward by swing gears 33, the leading edge of arm 34*c* cams over the sloping face of latch portion 37*a* until latch portion 37*a* engages catch 34*d* at which time, the rack member 34 is held in a forward position against the bias of spring 35. In moving forward, the rack member 34 moves a cam arm 36 forward and/or upward against the upper jaw portion 20*a*, pivoting that portion 20*a* upward. The cam arm 36 can be moved linearly forward to abut and then run along an appropriately sloping surface on the under side of the upper jaw member 20*a* or can be pivotally coupled with the upper jaw member 20*a* so that as the rack member 34 moves forward, the arm swings rearward and up raising the upper jaw member. Neither are depicted.

The jaw moving mechanism 31 is tripped by firm contact with the actuator/trigger 38. The actuator/trigger 38 is movably mounted on the chassis 18 for sliding and/or pivoting movement. When forced rearward, the rear or innermost end of actuator/trigger 38 strikes the trip member portion 37*c* biasing it downward and releasing the latch portion 37*a* from the catch 34*d*. The actuator/trigger 38 can be biased back to its original forward position by the same bias member used to keep the latch member 37 elevated, or by its own bias member.

It will be appreciated that although use a rack member 34 with separate racks 34*a* engageable with swing gears 33 is preferred, it would be possible to use other moving mechanisms that include a moving member at least operably engageable with the movable member and a pair of rotary swing members on opposite side of the moving member, the rotary swing members being drivingly engaged with the moving member only with both of the first and second motors being driven simultaneously in predetermined directions. For example, the movable mechanism might include a track member with separate toothless track surfaces in place of the rack member and separate racks. Other types of rotary swing members like friction rollers or wheels driven by the motors in place of swing gears 33 and trap and engage such track member by friction to move it and the movable member.

The at least two drive motors 24, 28 utilized in the present embodiment can be 180 size brushed DC ("BDC") electric motors. However, it will be apparent to one skilled in the art that various types and sizes of motors can be utilized without departing from the scope and spirit of the invention.

The at least two drive motors 24, 28 in the housing 20 permit a "tank-like" differential drive capability for effectuating a sine-wave slithering motion as the toy snake 10 moves. For example, when a motor control toggle 105*a*, 105*b* located on the hand-held remote transmitter/controller 105 is deflected from a generally central, nominal resting or neutral position, the toy snake 10 is caused to move by way of the drive motor to wheel connection relative to the direction deflected on the directional control toggle. Specifically, when the left directional control toggle 105*a* is pivoted forward or backward, the drive motor 24 connected to left side drive wheel 22 is caused to rotate the wheel 22 in the desired direction (i.e., forward or backward). The drive motor 28 connected to a right side drive wheel 26 similarly causes the right side wheel 26 to rotate in the desired direction depending on the movement of the directional control toggle 105*b*.

The body 40 of the toy snake 10 comprises a plurality of body segments or members 41 connected together end-to-end in such a fashion as to permit body articulation throughout substantially the entire body 40 of the toy snake 10. The body members 41 are constructed of, but not limited to, a plastic type material of a design as shown in the accompanying figures. However, one skilled in the art will understand that any variety of materials can be used to construct the body members 41 and the design can take on any desired appearance without departing from the scope and spirit of the present invention. In particular, each body segment 41 includes a carriage 42. Each carriage 42 and body member 41 has a front end 43, a rear end 44, a top side 46, a bottom side 37 and opposing lateral sides 48, 49 extending between the front and rear ends. Each body member 41 includes at least one laterally extending outrigger, preferably generally planar wing 51, 52, extending generally laterally outward from each lateral side 48, 49, respectively of the carriage 42 and segment 41. Most body segments 41 (all but one in this embodiment) also has a generally planar, upwardly extending fin 54 laterally centered on the top side 46 of the carriage 42. Wings 51, 52 are decorative but also provide balance to each body section 41 and can prevent each body section from pitching sideways if not already prevented by the limited movement provided by the articulated couplings 45.

Each body member 41 comprises at least one and preferably only one centrally located, rotatable, ground contacting wheel 50 for permitting mobility across a surface "S" supporting the toy snake 10. The plurality of body members 41 are preferably articulatedly coupled to each other, end-to-end, by way of an articulated coupling indicated generally at 45. While the articulated coupling may be of any of a variety of configurations, a simple and inexpensive coupling is provided by a generally vertical pin in one of the body sections passed though an enlarge vertical hole in an adjoining body section sufficiently enlarged so that some vertical pitching movement is permitted between linked, adjoining body members in addition to side to side yaw movement. Thus, the body members 41 can be identical with a hinge pin at one end and a pin receiving hole at the other end. Furthermore the front end of the first body member 41 of the body 40, which is most proximal to the head segment 12, can be coupled with the rear end of the head segment 12 by the same type of articulated coupling. When the plurality of body members 41 are connected to each other and the chassis 12 by way of the articulated couplings, the toy snake 10 has the appearance, during operational movement by way of radio control operations, of an articulating snake as it slithers quickly across the ground. Preferably the body 40 includes at least one trailer segment (or "trailer") 56 at the end of the body 40 most distal to the head and pivotally coupled to the last body member 41 of the body 40. More than one trailer can be provided pivotally coupled to a preceding trailer. Each trailer would be characterized by the lack of an unlying wheel which would inhibit the side to side movement of the trailer 56.

It will be understood by one skilled in the art that the toy snake 10 described herein by the present invention can be designed to mimic virtually any creature having virtually any plurality of designs without departing from the scope and spirit of the present invention.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described components (assemblies, devices, circuits, etc.), the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more other features of the other embodiments as may be desired. Additionally, for the most part, details concerning particular chemical reactions, chemical properties, and the like, have been omitted inasmuch as such details are not considered necessary to obtain a complete understanding of the present invention, and are considered to be within the understanding of persons of ordinary skill in the relevant art.

It is therefore, contemplated that the claims will cover any such modifications or embodiments that fall within the true scope of the invention.

We claim:

1. A motorized toy in the form of a motorized, multi-segmented, articulated toy snake comprising:

a chassis with an outer housing;

at least first and second ground contacting wheels rotatably supported from the chassis;

a first reversible electric motor operably connected with at least the first of the first and second ground contacting wheels to drive the first wheel;

a second reversible electric motor operably connected with at least the second of the first and second ground contacting wheels to drive the second wheel, the second motor being separately operable from the first motor to maneuver the toy;

a movable member movably coupled with one of the chassis and outer housing; and a moving mechanism operably connected with the movable member sufficiently to move the movable member from a first position to a second position, the moving mechanism being powered only by simultaneous operation of the first and second motors;

wherein the chassis is one segment of the snake and has a front end and a rear end, a top side and an opposing bottom side, the first and second ground contacting drive wheels being mounted side-by-side on the bottom side between the front end and the rear end, the outer housing has a snake-head-like appearance, the chassis further includes an electric power supply and an electric controller selectively operably connecting at least the first electric motor and the second electric motor with the electric power supply, and the movable member being an upper jaw moving portion of the outer housing hinged to one of the chassis and a remainder of the outer housing; the toy snake further comprising:

a multi-segmented body pivotally coupled to the rear end of the chassis, the body including at least a plurality of individual body segments connected end to end, a first body segment being articulated to the rear end of the chassis and a front end of each other body segment of the plurality being articulated to a rear end of a proceeding body segment of the plurality, each body segment including a carriage, each carriage having a top side, a bottom side and first and second opposing lateral sides extending between the front and rear ends.

2. The motorized, multi-segmented, articulated toy snake of claim 1, wherein the moving mechanism includes first and second jaw moving mechanisms, the first and second jaw moving mechanisms each including a drive gear and a swing gear on either side of a rack member, each drive gear being driven by a separate one of the first and second motors and meshed with one of the swing gears, each swing gear being moveable along a slot when rotated by the drive gear, the rack member including opposing racks, each of the opposing racks facing away from the other rack and toward a separate one of the swing gears.

3. The motorized, multi-segmented, articulated toy snake of claim 2, wherein the rack member is moveable in a lateral direction such that when both first and second motors are driven in a reverse direction, each swing gear is moved along one of the slots, toward the rack member and into driving engagement with one of the racks and if only one of the first and second motors is driven in reverse, the rack member displaces laterally away from the driving swing gear and the rack member does not advance.

4. The motorized, multi-segmented, articulated toy snake of claim 3, wherein the rack member includes a cam arm and when both first and second motors are driven simultaneously in reverse, both swing gears engage the rack member and drive the rack member in one of a forward and rear directions, wherein moving the rack member in one of the forward and rear directions moves the cam arm against the upper jaw moving portion, pivoting the upper jaw moving portion into an open position.

5. The motorized, multi-segmented, articulated toy snake of claim 4, wherein the chassis includes a latch and trigger and the rack member is spring biased with respect to the chassis such that when the upper jaw moving portion is in the open position the rack member engages the latch to hold the upper jaw moving portion in the open position and the latch may be released to close the upper jaw moving portion by activating the trigger.

6. The motorized, multi-segmented, articulated toy snake of claim 5, wherein the trigger resembles a tongue extending from the front end of the chassis.

7. The motorized, multi-segmented, articulated toy snake of claim 1, wherein the upper jaw moving portion is raised by at least one of the first and second motors.

8. The motorized, multi-segmented, articulated toy snake of claim 7, wherein the upper jaw moving portion is raised by the combined operation of both of the first and second motors.

9. The motorized, multi-segmented, articulated toy snake of claim 8, wherein the upper jaw moving portion is only raised when both the first and second motors are driven in a reverse direction, the reverse directions of the first and second motors being opposite to a direction of the first and second motors used to propel the chassis segment in a forward direction.

10. The motorized, multi-segmented, articulated toy snake of claim 1, wherein each carriage further includes at least one ground contacting support wheel on the bottom side.

11. The motorized, multi-segmented, articulated toy snake of claim 10, wherein the body further includes at least one follower segment without a ground contacting support wheel pivotally connected to the rear end of a final one of the plurality of body segments with at least one ground contacting support wheel.

12. The motorized, multi-segmented, articulated toy snake of claim 1 further comprising a trigger extending from the chassis and outer housing and operably coupled with the moving mechanism to release the upper jaw moving portion from a raised position.

13. The motorized, multi-segmented, articulated toy snake of claim 1, wherein at least one body segment includes a generally planar, upwardly extending fin laterally centered on the top side of the carriage and at least one generally planar wing extending generally laterally outward from each lateral side of the carriage.

14. A motorized toy in the form of a creature comprising:

a chassis with an outer housing;

at least first and second ground contacting wheels rotatably supported from the chassis;

a first reversible electric motor operably connected with at least the first of the first and second ground contacting wheels to drive the first wheel;

a second reversible electric motor operably connected with at least the second of the first and second ground contacting wheels to drive the second wheel, the second motor being separately operable from the first motor to maneuver the toy;

a movable member movably coupled with one of the chassis and outer housing; and a moving mechanism operably connected with the movable member sufficiently to move the movable member from a first position to a second position, the moving mechanism being powered only by simultaneous operation of the first and second motors; wherein:

the movable member is a movable jaw member of the creature pivotally coupled with one of the chassis and outer housing;

the moving mechanism is a jaw moving mechanism powered by the first and second motors to raise the movable jaw member; and the motorized toy further comprising:

a trigger extending from the chassis and outer housing and operably coupled with the jaw moving mechanism so as to release the movable jaw member from a raised position.

15. A motorized toy comprising:

a chassis with an outer housing;

at least first and second ground contacting wheels rotatably supported from the chassis;

a first reversible electric motor operably connected with at least the first of the first and second ground contacting wheels to drive the first wheel;

a second reversible electric motor operably connected with at least the second of the first and second ground contacting wheels to drive the second wheel, the second motor being separately operable from the first motor to maneuver the toy;

a movable member movably coupled with one of the chassis and outer housing; and a moving mechanism operably connected with the movable member sufficiently to move the movable member from a first position to a second position, the moving mechanism being powered only by simultaneous operation of the first and second motors;

wherein the moving mechanism includes a moving member at least operably engageable with the movable member and a pair of rotary swing members movable along slots on opposite sides of the moving member, the rotary swing members trapping and drivingly engaging with the moving member only with both of the first and second motors being driven simultaneously in predetermined directions.

16. A motorized toy comprising:

a chassis with an outer housing;

at least first and second ground contacting wheels rotatably supported from the chassis;

a first reversible electric motor operably connected with at least the first of the first and second ground contacting wheels to drive the first wheel;

a second reversible electric motor operably connected with at least the second of the first and second ground contacting wheels to drive the second wheel, the second motor being separately operable from the first motor to maneuver the toy;

a movable member movably coupled with one of the chassis and outer housing; and a moving mechanism operably connected with the movable member sufficiently to move the movable member from a first position to a second position, the moving mechanism being powered only by simultaneous operation of the first and second motors;

wherein the moving mechanism includes a rack member having opposing racks on opposing sides of the rack member, a separate swing gear on either of the opposing sides of the rack member, a separate drive gear on either of the opposing sides of the rack member, each swing gear being driven by a separate one of the first and second motors and each swing gear being moveable along a slot when rotated by the drive gear.

17. A motorized toy comprising:

a chassis with an outer housing;

at least first and second ground contacting wheels rotatably supported from the chassis;

a first reversible electric motor operably connected with at least the first of the first and second ground contacting wheels to drive the first wheel;

a second reversible electric motor operably connected with at least the second of the first and second ground contacting wheels to drive the second wheel, the second motor being separately operable from the first motor to maneuver the toy;

a movable member movably coupled with one of the chassis and outer housing;

a moving mechanism operably connected with the movable member sufficiently to move the movable member from a first position to a second position, the moving mechanism being powered only by simultaneous operation of the first and second motors;

a latch member located and configured to releasably engage the moving mechanism with the movable member in the second position to releasably hold the moving mechanism and the movable member in the second position; and a trigger extending from one of the chassis and outer housing and operably connected with the latch member in at least the second position to release the latch member from the moving mechanism and permit return of the movable member to the first position.

* * * * *